United States Patent [19]

Huth

[11] 4,454,969

[45] Jun. 19, 1984

[54] HANGER ASSEMBLY

[76] Inventor: John W. Huth, 411 Crest Dr., Cary, Ill. 60013

[21] Appl. No.: 271,137

[22] Filed: Jun. 9, 1981

[51] Int. Cl.[3] ..... A47J 51/142

[52] U.S. Cl. ..... 223/96; 211/113; 24/542; 24/455

[58] Field of Search ..... 223/85, 91, 93, 96, 223/DIG. 2; 211/45, 113; 24/251, 260, 187 A

[56] References Cited

U.S. PATENT DOCUMENTS

| | | | |
|---|---|---|---|
| 541,293 | 6/1895 | Smith . | |
| 791,142 | 5/1905 | Farrell . | |
| 863,993 | 8/1907 | Hunter | 160/330 |
| 1,014,597 | 1/1912 | Hewlett | 223/96 X |
| 1,511,851 | 10/1924 | Valder | 223/96 |
| 1,912,199 | 5/1933 | Hoerner | 223/96 X |
| 1,971,794 | 8/1934 | Panettiere . | |
| 2,805,013 | 9/1957 | Comfort | 223/96 |
| 2,902,173 | 9/1959 | Staffeld . | |
| 3,191,823 | 6/1965 | Edwardes . | |
| 3,512,228 | 5/1970 | Carvell . | |
| 3,603,491 | 9/1971 | Wright . | |
| 3,738,550 | 6/1973 | Etta et al. . | |
| 3,767,092 | 10/1973 | Garrison et al. . | |
| 4,177,908 | 12/1979 | Batts et al. . | |
| 4,221,298 | 9/1980 | Wright et al. | 223/85 X |
| 4,238,865 | 12/1980 | Ingemann et al. | 24/260 X |

FOREIGN PATENT DOCUMENTS

| | | | |
|---|---|---|---|
| 13150 | 8/1903 | Austria | 223/91 |
| 501636 | 7/1930 | Fed. Rep. of Germany | 223/96 |
| 456287 | 3/1950 | Italy | 223/85 |
| 1220830 | 1/1971 | United Kingdom | 223/96 |

*Primary Examiner*—Robert Mackey

*Attorney, Agent, or Firm*—Mathew R. P. Perrone, Jr.

[57] ABSTRACT

A hanger assembly for hanging clothes is formed by securing a pair of bars together at one end to form a clothes clamp and leaving the clothes clamp open at the other end for the purpose of receiving clothes. The clothes clamp is locked by a slotted, resilient, tubular member which slides into the slotted portion of the clothes clamp and has a hanger diametrically opposed to the slot.

3 Claims, 4 Drawing Figures

HANGER ASSEMBLY

BACKGROUND OF THE INVENTION

This invention relates to hangers and more particularly to a hanger having a clamp for holding the clothes and a separate clamp lock for locking the clothes in the clamp.

Many problems in the art of hanging clothes revolves around a particular hanger used to hang them. The hanger must be simply operated, and yet provide a solid means for holding the clothes in position. Yet at the same time, the hands of the user of the hanger must be substantially free in order to first arrange the clothes neatly, and then place them in the hanger. While the clothes are placed in the hanger, there must be a simple way of holding the clothes in the hanger until the hanger can be locked around the clothes.

Another problem with hangers is that clothes may be crushed in a closet and wrinkled. If it were possible to prevent this wrinkling, the advantages thereof are clear.

This combination of features has rendered it extremely difficult to provide a suitable hanger for the purposes involved.

SUMMARY OF THE INVENTION

Therefore, it is an object of this invention to provide a hanger which permits clothes to be held neatly.

A further object of this invention is to provide a hanger which permits clothes to be simply held in the hanger until the hanger is locked about the clothes.

A still further object of this invention is to provide a hanger which has a simple locking means for hanging clothes.

Also an object of this invention is provide a hanger which minimizes wrinkling of clothes.

These and other objects of the invention are met by having a hanger with a clothes clamp separate from the clamp lock so that the clothes can be held in the clamp while the clamp lock is applied.

DESCRIPTION OF THE PREFERRED EMBODIMENT

A hanger including a clothes clamp in a clothes clamp lock provides an efficient means for hanging clothes quickly and neatly.

Figure 1:
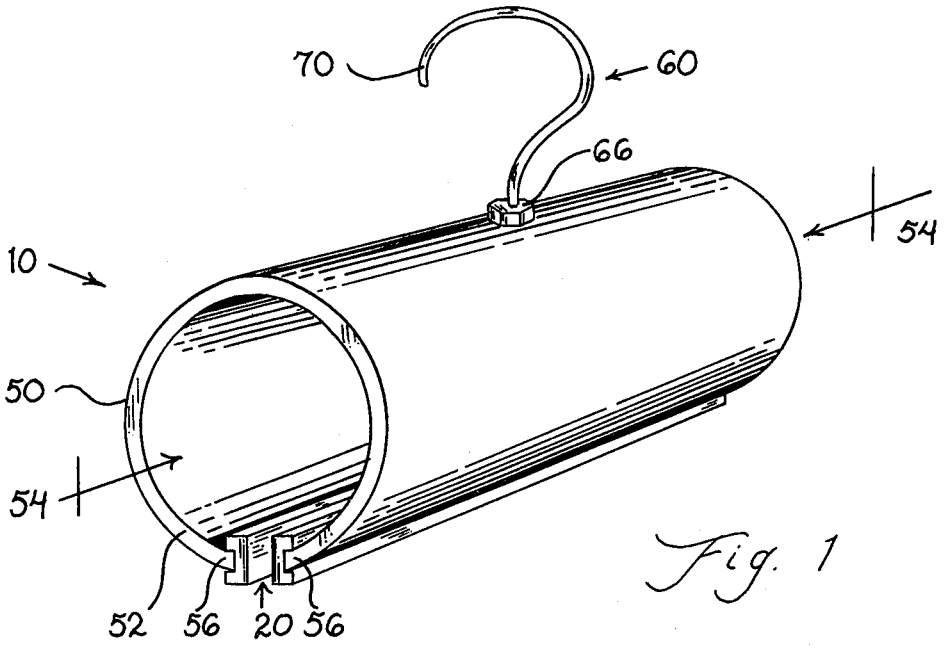
FIG. 1 depicts hanger assembly 10 of this invention.
Figure 2:
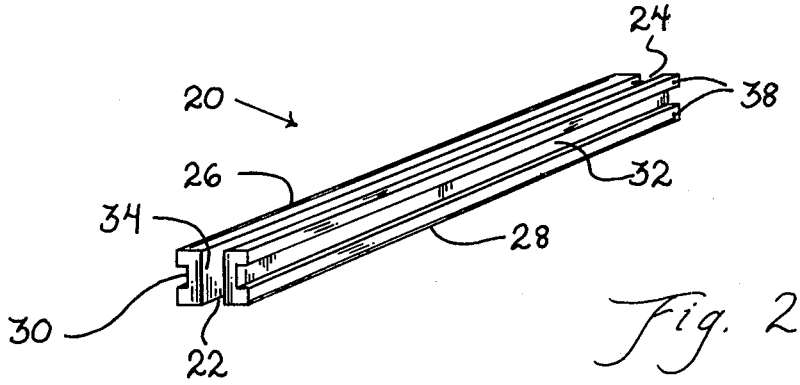
FIG. 2 depicts clothes clamp 20 of this invention.
Figure 3:
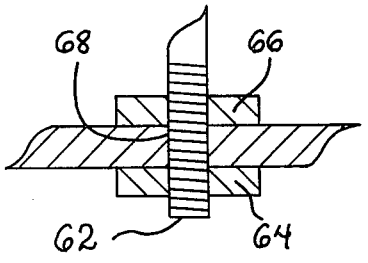
FIG. 3 depicts the mounting of hanger 60 in the clamp lock 50.
Figure 4:
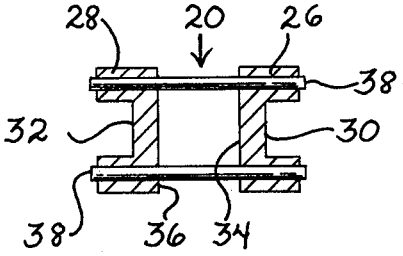
FIG. 4 depicts the secured end 24 of clothes clamp 20.

Hanger assembly 10 includes clothes clamp 20 and clamp lock 50 mounted thereon. Turning more specifically to the clothes clamp 20, as shown in FIG. 2, clothes clamp 20 includes an open end 22, and a secured end 24. Clothes clamp 20 has a first slot bar 26 and a second slot bar 28 joined at a secured end 24 and open at open end 22. Clothes are passed into clothes clamp 20 between first slot bar 26 and second slot bar 28 and held in place therebetween. The mounting for clamp lock 50 in first slot bar 26 is first slot 30. The mounting for clamp lock 50 in second slot bar 28 is second slot 32. As can be seen from FIG. 1, clamp lock 50 slides into first slot 30 and second slot 32 and forces first slot bar 26 and second slot bar 28 together. In this manner, first clothes contacting surface 34 on first slot bar 26 approaches second clothes contacting surface 36 on second slot bar 28 and secures clothes in position.

At secured end 24 of clothes clamp 20, bar fasteners 38 are welded, glued or otherwise secured to hold first slot bar 26 and second slot bar 28 together.

Tubular clamp lock 50 includes clamp holder 52 and hanger 60. Clamp holder 52 is tubular in nature and has a tubular axis 54. Tubular axis 54 is centrally located down the clamp holder 52 and assumes the standard geometrical position of an axis. Parallel to the tubular axis 54 in the side of tubular clamp holder 52 is a slotted clamp contact 56. Slotted clamp contact 56 runs along the length of tubular clamp holder 52 and is parallel to the tubular axis 54. It is at the slotted clamp contact 56 that the tubular clamp holder 52 contacts first slot 30 and second slot 32 to lock the clothes within the clothes clamp 20.

Another feature of tubular clamp lock 50 is that the diameter of clamp lock 50 provides a spacer to prevent the crushing together of clothes, which crushing can result in wrinkling of the clothes. So when the hanger assembly 10 of this invention is placed in a closet, tubular clamp lock 50 can abut the adjacent clothes without allowing the clothes hung therefrom to touch.

Hanger 60 includes threaded end 62 and hook end 70 oppositely disposed from each other. Interior nut 64 is in threaded relation with threaded end 62 on the interior of clamp holder 52. Exterior nut 66 is also in threaded relation with threaded end 62 on the exterior of clamp holder 52 and between clamp holder 52 and hook end 70. Thus, hanger 60 is held in place by the cooperation of interior nut 64 and exterior nut 66. Threaded end 62 fits through hanger aperture 68. Aperture 68 is centrally located in clamp holder 52 and diametrically opposed to slotted clamp contact 56.

Clothes clamp 20 may be secured in any suitable fashion. Bar fasteners 38 are pieces of metal welded or otherwise secured in first slot bar 26 and second slot bar 28 to hold them together at secured end 24. Any other suitable means of securing the bars together is practical. First slot bar 26 and second slot bar 28 could be hinged together, made of one unitary piece and bent, or joined in any other suitable fashion.

In operation hanger assembly 10 is operated simply. The clothes are held in a desired position and slid into clothes clamp 20 through opened end 22. Secured end 24 permits one hand to hold clothes clamp 20 in place while the other hand slides clamp lock 50 into first slot bar 26 and second slot bar 28 thereby locking the clothes in place.

Clothes clamp 20 may be made of metal or synthetic resin. The only requirement for materials in hanger assembly 10 including clothes clamp 20 and clamp lock 50, are that the materials be non-reactive with the clothing they are holding. Thus, it may be seen that clothes clamp 20 may be made of metal or synthetic resin. Clamp lock 50 may be made of any suitable material so long as it has the desired flexibility to slide onto clothes clamp 20 and hold the clothes in place while at the same time being flexible enough to be removed from clothes clamp 20 when it is desired to take the clothes off the hanger. Typical synthetic resins for use in this invention include polymethyl methacrylate, polycarbonates, polyurethanes or similar materials.

What is claimed and sought to be secured by Letters Patent of the United States is:

1. A hanger assembly for simplified hanging of clothes and spacing of clothes from adjacent hangers comprising:

a. a clamping means for holding said clothes;

b. a separate clamp locking means for locking said clamping means to said clothes, and for spacing of said clothes from an adjacent member of said hanger assembly;

c. said clamping means further comprising a first clothes holding member and a second clothes holding member;

d. said first clothes holding member and said second clothes holding member each having a first end and a second end oppositely disposed from said first end;

e. said first end of said first clothes holding member adjacent said first end of said second clothes holding member and said second end of said first clothes holding member adjacent said second end of said second clothes holding member;

f. said first end of said first clothes holding member being secured to said first end of said second clothes holding member;

g. said clamp locking means includes a tubular member having therein a slotted clamp contact for contacting said clamping means in the side of said tubular member parallel to a tubular axis of said tubular member being removably and slideably mountable on said clamping means to lock said clothes between said first clothes holding member and said second clothes holding member;

h. said clamp locking means being of sufficient size to space said hanger assembly from an adjacent hanger assembly;

i. a hanging means diametrically opposed to said slotted clamp contact and centrally located in the wall of said tubular member;

j. said first clothes holding member having a first interior clothes contacting surface and a first exterior clamp lock mating surface oppositely disposed therefrom;

k. said second clothes holding member having a second interior clothes contacting surface and a second exterior clamp lock mating surface oppositely disposed therefrom;

l. said first interior clothes contacting surface being adjacent said second interior clothes contacting surface and being separable therefrom by said clothes being inserted therebetween; and m. said first exterior clamp lock mating surface and second exterior clamp lock mating surface both include a clamp lock receiving slot for receiving said clamp locking means.

2. The hanger assembly of claim 1, wherein the hanging means is secured in said clamp locking means by means of an interior securing means secured to said hanging means on the interior of said locking means and an exterior locking means secured to said hanging means on the exterior of said locking means.

3. The hanger assembly of claim 1 wherein said hanging means has at one thereof a hook suitable for engaging a clothes pole and at the other end thereof a threaded portion suitable for securing nuts thereto to thereby secure said hanging means within said tubular member.

* * * * *